United States Patent [19]

Mazur

[11] 4,372,409

[45] Feb. 8, 1983

[54] CROSS-FLOW FAN FOR TRANSVERSE ENGINE VEHICLE

[75] Inventor: Joseph S. Mazur, Livonia, Mich.

[73] Assignee: Eaton Corporation, Cleveland, Ohio

[21] Appl. No.: 172,882

[22] Filed: Jul. 28, 1980

[51] Int. Cl.[3] ..... B60H 1/024

[52] U.S. Cl. ..... 180/54 A; 98/2.06; 123/41.49; 123/41.65; 123/41.7; 165/122; 180/68 R; 237/12.3 A; 237/12.3 B; 416/187; 474/12; 474/113

[58] Field of Search ..... 180/297, 291, 54 A, 180/54 R, 68 R; 416/187, 178; 60/377, DIG. 5; 123/41.63, 41.65, 41.7, 41.49; 417/362, 423 R; 474/12, 113; 165/41, 44, 67, 122, 149; 98/2.06, 2.05; 237/12.3 A, 12.5 B

[56] References Cited

U.S. PATENT DOCUMENTS

| | | | |
|---|---|---|---|
| 2,204,926 | 6/1940 | Clingerman | 180/54 A |
| 2,511,549 | 6/1950 | Simi | 180/54 A |
| 2,680,490 | 6/1954 | Dafoe | 180/54 A |
| 3,613,645 | 10/1971 | Froumajou et al. | 180/54 R X |
| 3,630,003 | 12/1971 | Ashton et al. | 180/68 R X |
| 3,696,730 | 10/1972 | Masuda et al. | 180/54 A X |
| 3,856,100 | 12/1974 | Manning | 180/54 A |
| 3,915,024 | 10/1975 | Mort | 180/68 R X |
| 3,918,547 | 11/1975 | Kramer et al. | 180/54 A |
| 3,970,411 | 7/1976 | Wallman | 416/187 X |
| 4,007,999 | 2/1977 | Serizawa | 416/187 X |
| 4,175,388 | 11/1979 | Milbreath et al. | 60/337 |

FOREIGN PATENT DOCUMENTS

| | | | |
|---|---|---|---|
| 885222 | 12/1961 | United Kingdom | 123/41.65 |

*Primary Examiner*—Robert R. Song
*Assistant Examiner*—M. J. Hill
*Attorney, Agent, or Firm*—C. H. Grace; P. S. Rulon

[57] ABSTRACT

Disclosed is a vehicle having a transversely mounted engine (20), an engine cooling radiator (22) mounted forward of the engine and substantially parallel to the rotational axis of the engine crankshaft, a cross-flow fan (24) mounted for rotation about an axis substantially parallel to the crankshaft axis and between the crankshaft axis and plane of the radiator, and a mechanical drive (32, 34, 36) which rotates the fan in response to rotation of the crankshaft.

8 Claims, 7 Drawing Figures

Fig. 1.
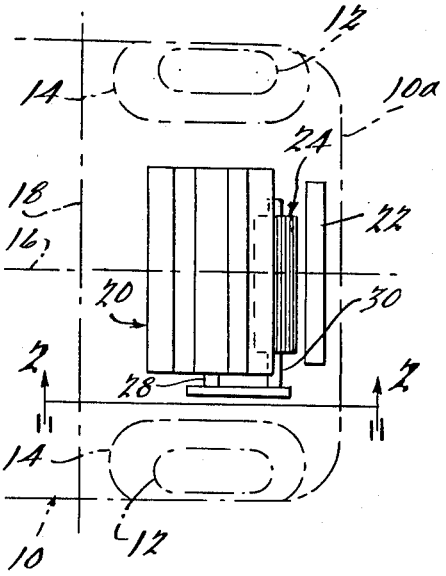
Fig. 2.
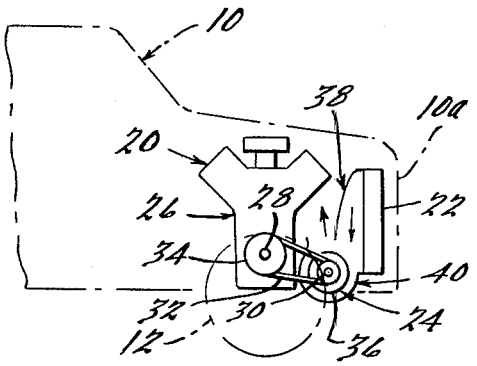
Fig. 3.
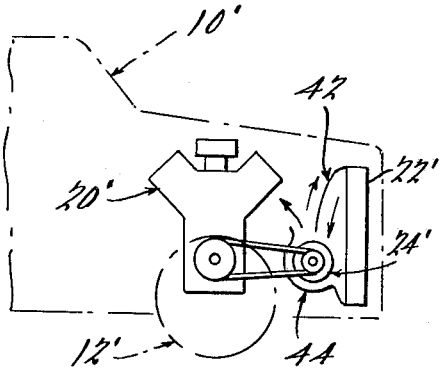
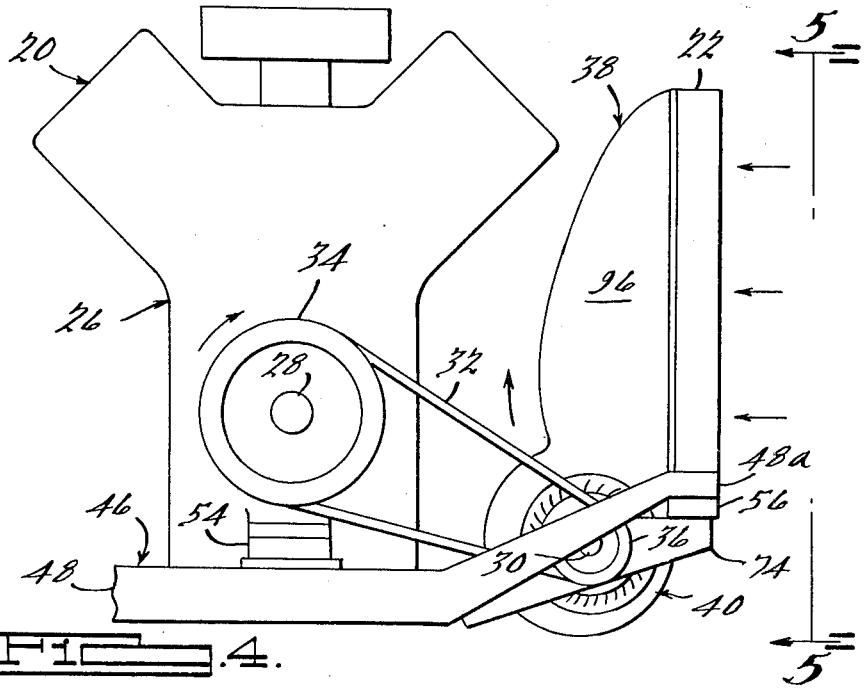
Fig. 4.

CROSS-FLOW FAN FOR TRANSVERSE ENGINE VEHICLE

CROSS-REFERENCE TO RELATED APPLICATIONS

This application is related to U.S. patent application Ser. Nos. 183,508, filed Sept. 2, 1980 and 183,890, filed Sept. 4, 1980. Both applications are assigned to the assignee of this application.

FIELD OF THE INVENTION

This invention relates to vehicle engine cooling and, in particular, to a mechanically driven cooling fan for a vehicle having a transversely mounted engine.

BACKGROUND OF THE INVENTION

The current proliferation of front wheel drive vehicles with liquid-cooled engines mounted transverse to the longitudinal axis of the vehicle has complicated traditional cooling fan drive arrangements wherein the engine is mounted parallel to the longitudinal axis of the vehicle. Vehicles with either longitudinally or transversely mounted engines preferably have the radiator positioned forwardly of the engine and in a plane transverse to the longitudinal axis since such positioning provides direct access for ambient air flow through the radiator, particularly ram air, and since space for the radiator is readily provided with such positioning.

In vehicles with longitudinally mounted engines, forwardly mounted radiators, and axial flow fans mounted between the engines and the radiators, the axial flow fans are conveniently mounted on the front of the engines with their rotational axes parallel to the engine crankshaft axes and are readily driven by mechanical drives, such as belts driven by pulleys mounted on forward projections of the engine crankshafts. Such arrangements are simple, reliable, relatively inexpensive, and last, but not least, relatively efficient. In vehicles with transversely mounted engines, forwardly mounted radiators, and axial flow fans mounted between the engines and the radiators, the axial flow fans cannot, as a practical matter, be mounted on the engines with their rotational axes parallel to the engine crankshaft axes and cannot be readily driven by mechanical drives, such as belts driven by pulleys mounted on projections of the engine crankshafts. Hence, vehicles with transversely mounted engins and radiators positioned forwardly of the engines, for the most part, now use electric motors to drive the fans. The electric motors are in general more expensive than the mechanically driven fans and are believed to be less reliable. Further, since the electric motors are price sensitive per unit of horsepower and substantially less efficient than mechanical drives, some vehicle manufacturers have increased the size of the radiators to reduce the motor size and have spent considerable time developing more efficient axial flow fans to further reduce motor size.

One prior art reference, U.S. Pat. No. 3,696,730 issued Oct. 10, 1972, schematically discloses a transverse engine vehicle with a forwardly mounted radiator and several embodiments of mechanically driven fans. One embodiment discloses a centrifugal fan with axial inlet and radial outlet mounted on one end of the engine. The other embodiments disclose axial flow fans transversely disposed with respect to one end of the engine and with the rotational axes of the fans either in line with the engine crankshaft axis or forward thereof. All of these embodiments require transverse offsetting of the radiators and/or the engines, transverse offsetting of the fans, bulky ducts for directing air to and from the fans, and tortuous flow paths for the air. Transverse offsetting of the radiators, though possible even in relatively small cars, is not desirable since it interferes with headlight and fender mountings unless the front of the vehicle is extended to provide additional room. Transverse offsetting of transversely mounted engines is undesirable since it upsets vehicle weight distribution and, as a practical matter, there is insufficient transverse space for such offsetting in passenger vehicles with forwardly mounted transverse engines. Likewise, there is insufficient transverse space for transverse offsetting or positioning of the fans at one end of the engines. Further, the bulky or large ducts for directing the air to and from the fans would at best be difficult to install in the limited space available in such vehicles.

SUMMARY OF THE INVENTION

An object of this invention is to provide a compact and efficient cooling fan for liquid cooled engines in a vehicle.

Another object of this invention is to provide such a fan which is mechanically driven by an engine crankshaft in a vehicle having a transversely mounted engine.

According to a feature of the invention, a vehicle includes a liquid cooled engine having a crankshaft mounted therein for rotation, a radiator disposed in a plane spaced from and substantially parallel to the crankshaft axis, and a cross-flow fan mounted for rotation about an axis spaced from and substantially parallel to the crankshaft axis and operative to direct cooling air through the radiator when rotated by a mechanical drive driven by the crankshaft.

BRIEF DESCRIPTION OF THE DRAWINGS

A cross-flow cooling fan and drive arrangement therefor of the present invention are shown in the accompanying drawings in which:

FIG. 1 is a downwardly looking schematic of the invention disposed in a partial outline of a vehicle;

FIG. 2 is a vertical schematic of the invention looking along line 2—2 of FIG. 1;

FIG. 3 is a modified schematic of the invention shown in FIG. 2;

FIG. 4 is an enlargement of a portion of FIG. 2, still in schematic form but with substantially more detail;

Figure 5:
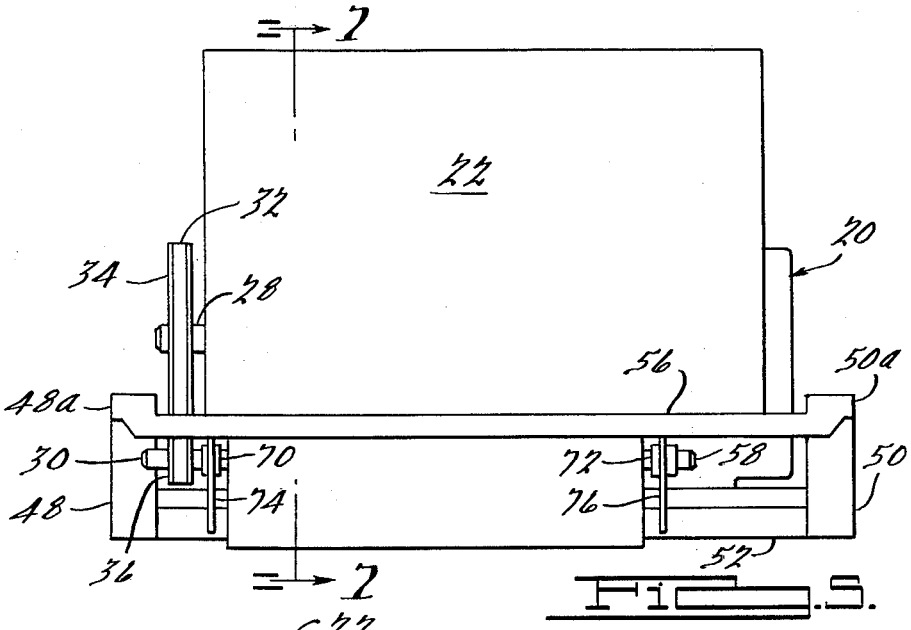
FIG. 5 is a vertical schematic of the invention looking along line 5—5 of FIG. 4.

Certain terminology referring to specific types of components, direction, motion, and the relationship of components to each other will be used in the following description. This terminology is for convenience in describing the invention and should not be considered limiting unless explicitly used in the claims.

DETAILED DESCRIPTION OF THE DRAWINGS

FIG. 1 is a plan view of a front portion of a vehicle with the vehicle body 10, front wheels 12, and inner fenders 14 shown in phantom lines. The vehicle grille or front 10*a* faces the direction of forward vehicle motion.

Axis line 16 represents the longitudinal axis of the vehicle and axis line 18 represents the transverse axis of the vehicle. Within body 10 is a transversely mounted engine 20 of the liquid-cooled type, a radiator 22 mounted behind the grille with its width substantially parallel to the transverse axis, and a cross-flow fan 24 mounted on the discharge or rear side of the radiator. Cross-flow fans, which are sometimes referred to as double traverse fans or tangential fans, are species of centrifugal fans but differ from commonly known centrifugal fans in that they pump air radially inward and outward such that the air passes chordally across the circumferential extent of the fans, whereas commonly known centrifugal fans pump air radially inward and then axially outward or axially inward and radially outward. For a given fan speed and pumping capacity cross-flow fans are generally smaller in diameter than commonly known centrifugal fans, whereby the cross-flow fans are more readily positioned in limited spaces. Further, since cross-flow fans pump air chordally across the circumferential extent of the fans, the fans and their inlet and outlet ducts may be positioned directly behind the radiators, whereby the packaging of the cross-flow fans and their ducts may be made substantially more compact than the packaging of the commonly known centrifugal fans and their related ducts.

Looking now at both FIGS. 1 and 2, engine 20, which may drive the front wheels and/or the rear wheels, includes a housing or block 26 having an unshown crankshaft mounted therein for rotation about an axis substantially parallel to the transverse axis. A shaft 28, which projects from block 26, may be an extension of the crankshaft or a shaft driven by the crankshaft. The cross-flow fan 24 includes an input shaft 30 defining an axis about which the fan rotates. The fan is mechanically driven in response to rotation of the engine crankshaft. Any of several well-known mechanical drive arrangements may be used. Herein, by way of example, the mechanical drive arrangement comprises a V-belt 32 and pulleys 34 and 36 fixed respectively to shafts 28 and 30. In FIG. 2, cross-flow fan 24 is shrouded by an inlet duct 38 and an outlet duct 40. Ducts 38 and 40 are not shown in FIG. 1 so that the position of the cross-flow fan with respect to the radiator and engine may be readily seen.

In the alternative embodiment of FIG. 3, components, which are substantially the same as components in FIGS. 1 and 2, are given the same reference numbers with the addition of a prime. The alternative embodiment is shown merely to illustrate that the fan 24' may be raised to a position directly between the radiator 22' and engine 20', if the distance therebetween is great enough. To the extent that the fan has thus far been described, the alternative embodiment merely requires differently shaped inlet and outlet ducts 42 and 44.

Figure 6:
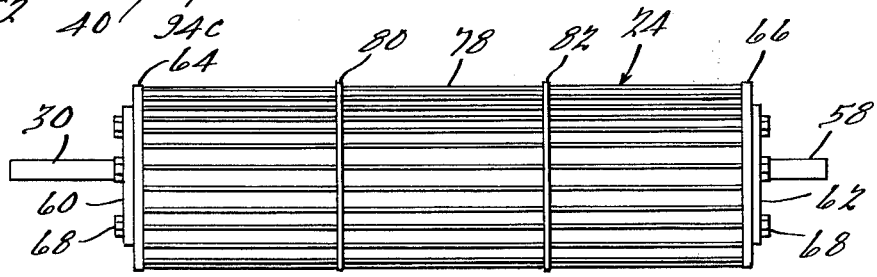
FIG. 6 is an enlarged view of a cross-flow fan which is partially shown in previous figures.

Looking now at FIGS. 4–6, which are more detailed schematics of the embodiment of FIGS. 1 and 2 and starting with FIGS. 4 and 5, engine 20 and radiator 22 are conventionally mounted on a vehicle frame 46. Frame 46 includes two horizontal, longitudinally extending rails 48 and 50 and a transverse cross member 52. One of the engine mounts is fixed to rail 48 and is shown at 54 in FIG. 4 only. Forward of the engine, rails 48 and 50 taper down and are bent upward at about a 30° angle. The forward ends **48*a* and 50*a* of the rails provide support for a transverse cross member 56** which supports the radiator.

As may be seen in FIGS. 5 and 6, cross-flow fan 24 includes the input drive shaft 30 at its left end and a shaft 58 at its right end. The shafts 30 and 58 are fixed to end plates 60 and 62 which are secured to end rings 64 and 66 of the fan by a plurality of bolts 68. Shafts 30 and 58 define the rotational axis of the fan and are journaled in bearings 70 and 72 carried by support members 74 and 76. Members 74 and 76 are fixed to cross members 52 and 56 such that the rotational axis of the fan is substantially parallel to the rotational axis of the engine crankshaft and behind the radiator with respect to the longitudinal axis. The outer circumferential extent of the fan is defined by a plurality of forwardly leaning blades 78 (herein twenty-four blades) which are circumferentially arrayed about the rotational axis of the fan. The forward leaning of blades 78 is most clearly shown in FIG. 7. The blades are supported at their ends by the end rings 64 and 66 and are supported therebetween by intermediate rings 80 and 82 with the axial extent of the blades parallel to the rotational axis and with the radial extent of the blades extending generally inward toward the rotational axis. The axial extent of blades 78 preferably, but not necessarily, extend the full or (as herein) substantially the full width of the radiator, thereby providing a direct and low resistance air flow path from the radiator to the fan. As may be seen in FIG. 5, fan 30 is positioned somewhat offset with respect to to the vertical center of the radiator. This offset positioning was done to minimize the length of input shaft 30 of the test vehicle. The test was conducted in a front wheel drive vehicle having a transversely mounted V-6 engine and a radiator about twenty-four inches wide. The test fan was about eighteen inches long and six inches in diameter.

Figure 7:
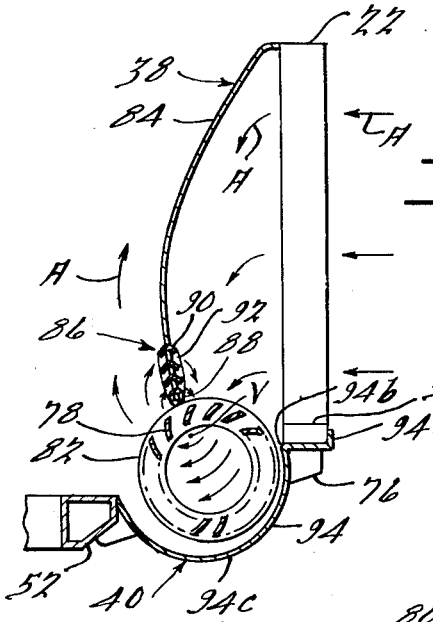
FIG. 7 is a sectioned portion of the invention looking alone line 7—7 of FIG. 5.

Looking now mainly at FIG. 7, the inlet and outlet ducts 38 and 40 may be formed of sheet metal or plastic materials. The inlet duct 38 includes a sheet metal member 84 fixed at its upper end to the radiator and extending downward and generally rearward to about the eleven o'clock position of the fan wherein it defines or is integrally formed with a cascade or louver assembly 86. The assembly includes a rod or tubular member 88 closely spaced outward of the outer circumferential extent of the fan blades and extending substantially the full axial extent of the blades, a plurality of V-shaped louvers 90 equal in length to member 88, and a plurality of vertically extending spacer or strut pieces 92 between the tubular member and the louvers. The outlet duct 40 includes a sheet metal member 94 extending the full axial length of the fan blades and including a portion **94*a* fixed to cross member 56, a portion 94*b* closely spaced radially outward of the fan blades at about the three o'clock position of the fan, and an involute portion 94*c* extending from portion 94*b* to about the eight o'clock position of the fan where it is fixed to cross member 52. Ducts 38 and 40 are closed at their left and right ends by said members common to both ducts. One side member 96 is shown in FIG. 4. In the other figures, side member 96 is removed so that the cross-flow fan may be readily seen. Tubular member 88 and portion 94*b*** define the circumferential boundaries separating the fan inlet area from the outlet area.

Looking now at the air flow through fan 24, a recirculation or back flow of air already transmitted to the inside of the fan or impeller is caused by an unavoidable internal vortex within the fan. The vortex is generally centered at a radial point traversed by the inner edges of the fan blades. The recirculating air or vortex size is responsible for energy losses which can be considerable. Fan efficiency, which is proportional to the total volume of the recirculating air, can be controlled by controlling the size of the vortex. The vortex within fan 24 is generally centered at about point V and is controlled by cascade assembly 86. Several other means for controlling the vortex are known and can be found in Fans, Dr.-Ing. Bruno Eck, 1973 Vieweg & Sohn GmbH, Burgplatz 1, Braunschweig, which is incorporated herein by reference. Looking now at the air flow arrows A in FIG. 7, in general, the air flows in hook curved paths and in vertically extending planes which are generally parallel to the longitudinal axis of the vehicle. Air passes through the core of the radiator 22 to the inlet area of the fan where it is impelled radially inward by the blades 78 and chordally across the interior of the fan where it is then impelled radially outward by the blades to the discharge area. As may be seen, the radius of curvature of the air within the fan decreases in proportion to its proximity to the center V of the vortex. Due to the vortex, as the air leaves the fan it is impelled upward and to the right in a clockwise motion. A portion of this air passes through louvers 90 of the cascade assembly and back to the inlet area. The remainder of the air, due to the circular motion, forms a thin air stream over the width of the back side of sheet metal member 84, whereby the air readily flows through the confined space between the engine and member 84 without need for an extended outlet duct which in the test vehicle would interfer with components on the engine.

The preferred embodiments of the invention have been disclosed for illustrative purposes. Many variations and modifications of the preferred embodiments are believed to be within the spirit of the invention. To mention but a few of such variations, the mechanical V-belt drive disclosed herein could be repaced by a cog belt, a serpentine belt or a gear drive; the fan could be positioned towards the top of the radiator; the axial length and/or diameter of the fan may be varied; and a plural number of fans may be used. The following claims are intended to cover the inventive portions of the invention and variations and modifications within the spirt of the disclosed invention.

What is claimed is:

1. In a vehicle of the type including a forwardly mounted engine having a crankshaft mounted therein for rotation about an axis transverse to the longitudinal axis of the vehicle; a liquid cooling system for the engine having a radiator spaced forwardly of the engine with respect to the longitudinal axis and in a plane substantially parallel to the crankshaft axis with the air discharge side of the radiator facing the engine; a cooling fan for directing air through the radiator; means mounting the fan for rotation about an axis substantially parallel to and between the crankshaft axis and the plane of the radiator; and mechanical drive means for rotating the fan in response to rotation of the crankshaft; the improvement comprising:

a cross-flow fan defining the cooling fan, said fan having an outer circumferential extent defined by a plurality of blades circumferentially arrayed about the fan axis, said blades having a radial extent extending generally inward toward the fan axis of the fan, and said blades operative in response to rotation about the fan axis to pump the cooling air chordally across said circumferential extent in planes transverse to the axes of said fan and said crankshaft.

2. The vehicle of claim 1, wherein the radiator has a width running in the direction of said axes and wherein said blades have an axial extent with respect to the fan axis, said axial extent extending substantially the full width of the radiator.

3. The vehicle of claims 2, further including:

inlet duct means extending from the discharge side of the radiator to a first area radially outward of the outer circumferential extent of the fan and extending substantially the full axial extent of said blades.

4. The vehicle of claim 3, further including:

outlet duct means extending from a second area radially outward of the circumferential extent of the fan and extending substantially the full axial extent of said blades, said second area chordally disposed from said first area with respect to said outer circumferential extent.

5. The vehicle of said claim 1, wherein said cross-flow fan is disposed adjacent to the bottom of the radiator and the vehicle further includes:

inlet duct means disposed between the engine and discharge side of the radiator, said inlet duct means extending downward from the top of the radiator to a first area radially outward of the outer circumferential extent of the fan blades and defining in combination with a bottom portion of the radiator the inlet to said blades.

6. The vehicle of claim 5, further including:

outlet duct means disposed to discharge at least a portion of the cooling air from the fan vertically upward between the engine and inlet duct means.

7. In a vehicle of the type including a forwardly mounted engine having a crankshaft mounted therein for rotation about an axis transverse to the longitudinal axis of the vehicle; a liquid cooling system for the engine having a radiator spaced forward of the engine with respect to the longitudinal axis and having a width generally parallel to the crankshaft axis with the air discharge side of the radiator facing the engine; a cooling fan for directing air through the radiator; and mechanical drive means for rotating the fan in response to rotation of the crankshaft; the improvement comprising:

means mounting the cooling fan for rotation about an axis substantially parallel to the crankshaft axis, directly behind the radiator, and in front of the crankshaft, respectively;

a cross-flow fan defining the cooling fan, said fan having an outer circumferential extent defined by a plurality of blades circumferentially arrayed about the fan axis, said blades having a radial extent extending generally inward toward the fan axis and having an axial extent extending substantially the full width of the radiator, and said blades operative in response to rotation about the fan axis to pump the cooling air chordally across said circumferential extent in planes transverse to the axes of said fan and said crankshaft; and inlet duct means extending from the discharge side of the radiator to a first area radially outward of the outer circumferential extent of the fan and extending substantially the full axial extent of said blades.

8. The vehicle of claim 7, further including:

outlet duct means extending from a second area radially outward of the circumferential extent of the fan and extending substantially the full axial extent of said blades, said second area chordally disposed from said first area with respect to said outer circumferential extent.

* * * * *